US006187096B1

(12) United States Patent
Thut

(10) Patent No.: US 6,187,096 B1
(45) Date of Patent: Feb. 13, 2001

(54) SPRAY ASSEMBLY FOR MOLTEN METAL

(76) Inventor: Bruno H. Thut, 16755 Park Circle Dr., Chagrin Falls, OH (US) 44023-4598

( * ) Notice: Under 35 U.S.C. 154(b), the term of this patent shall be extended for 0 days.

(21) Appl. No.: 09/260,820

(22) Filed: Mar. 2, 1999

(51) Int. Cl.[7] ..... B05B 13/02; F04B 15/00

(52) U.S. Cl. ..... 118/300; 118/307; 118/419; 239/591; 417/423.15; 417/424.1

(58) Field of Search ..... 118/300, 305, 118/307, 400, 419; 239/223, 224, 591; 417/423.15, 424.1; 415/200

(56) References Cited

U.S. PATENT DOCUMENTS

| | | | | |
|---|---|---|---|---|
| 3,062,451 | | 11/1962 | Keohane, Jr. . | |
| 3,172,361 | | 3/1965 | Thouzeau . | |
| 3,253,783 | | 5/1966 | Probst et al. . | |
| 4,091,970 | | 5/1978 | Komiyama et al. . | |
| 4,187,984 | | 2/1980 | Hugelshofer . | |
| 5,203,681 | * | 4/1993 | Cooper | 417/424.1 |
| 5,261,611 | | 11/1993 | Huxford . | |
| 5,445,324 | | 8/1995 | Berry et al. . | |
| 5,538,556 | * | 7/1996 | Maitra et al. | 118/307 |
| 5,716,195 | * | 2/1998 | Thut | 417/53 |
| 5,725,668 | * | 3/1998 | Foster et al. | 118/411 |

OTHER PUBLICATIONS 26 page article: HTS Pump Equation for the Eighties, date unknown.

* cited by examiner

*Primary Examiner*—Shrive Beck
*Assistant Examiner*—Jennifer Calcagni
(74) *Attorney, Agent, or Firm*—Watts, Hoffmann, Fisher & Heinke, Co., LPA

(57) ABSTRACT

A pump for coating molten metal onto a substrate includes a base with an impeller chamber, at least one molten metal inlet opening to the base, at least one molten metal outlet opening from the base, and an impeller connected to one end of a motor driven shaft and rotatable in the impeller chamber, the base, shaft and impeller being made of refractory material. A conduit is in communication with the molten metal discharged from the molten metal outlet opening. The conduit is formed of refractory material and comprises an arcuate shaped portion in which molten metal outlet openings are disposed. An insulating region is located between the conduit and a motor support. The conduit has a shape and the conduit outlet openings are configured and arranged to discharge molten metal toward an interior of the conduit in upward and downward directions such that exterior surfaces of a workpiece passed therein are coated with molten metal. Also included are a spray assembly for a pump for pumping molten metal and a method of coating workpieces with molten metal.

21 Claims, 3 Drawing Sheets

SPRAY ASSEMBLY FOR MOLTEN METAL

TECHNICAL FIELD

This invention relates to pumps for pumping molten metal. More particularly, this invention relates to a spray assembly for spraying molten metal onto a substrate.

BACKGROUND OF THE INVENTION

A transfer pump generally transfers molten metal out of one furnace to another furnace, into a ladle, or the like. Transfer pumps typically include a motor carried by a motor mount, a shaft connected to the motor at one end, and an impeller connected to the other end of the shaft. Such pumps also include a base with an impeller chamber, the impeller being rotatable in the impeller chamber. Transfer pumps may either be top feed pumps or bottom feed pumps depending, among other things, on the configuration of the base and orientation of the impeller relative to the direction of shaft rotation. Support members extend between the motor mount and the base. The pump may include a shaft sleeve surrounding the shaft, support posts, and a tubular riser. The tubular riser is usually attached to a molten metal outlet opening in the base.

Transfer pumps may be designed with pump shaft bearings, impeller bearings and with bearings in the base that surround the impeller to avoid damage of the shaft and impeller due to contact with the base. The shaft, impeller, and support members for such pumps are immersed in molten metals such as aluminum, magnesium, zinc, lead, copper, iron and alloys thereof. The pump components that contact the molten metal are composed of a refractory material such as graphite or ceramic.

In a transfer pump, the tubular riser extends vertically upward from the molten metal outlet opening of the base and provides a passageway for molten metal. The riser typically extends vertically up to the motor mount from which a conduit in communication with the riser may direct molten metal to a remote location. The end of the tubular riser or pipe may be open for pouring molten metal unidirectionally onto substrates. In a coating operation, molten metal is poured in a stream, like water from a faucet, out of the riser opening towards the substrate. Coating substrates with such transfer pumps is typically slow and difficult due to the time required for the molten metal to drip around to all sides of a substrate or the time required for multiple passes of an object so that all sides are sufficiently coated. Moreover, the coating quality and uniformity of molten metal discharged in this manner onto a substrate are generally poor, the underside coating of the substrate being different than on other sides.

SUMMARY OF THE INVENTION

The present invention overcomes the prior art problems of directly coating molten metal onto a workpiece or substrate with a molten metal pump. The present invention simultaneously coats all of the exterior surfaces of the workpiece. The delays associated with having to wait for the molten metal to drip to the underside or for multiple coating passes to occur, are eliminated. Moreover, multidirectional coating of molten metal onto substrates improves coating uniformity and increases productivity.

The present invention is directed to a pump for pumping molten metal onto a workpiece or substrate to be coated. In particular, the pump includes a motor fastened to a motor support, a base having an impeller chamber, at least one molten metal inlet opening to the base, a molten metal outlet opening from the base, a shaft connected to the motor at one end, an impeller connected to the other end of the shaft and rotatable in the impeller chamber, an apertured conduit in communication with molten metal discharged from the base outlet opening and an insulating region located between the conduit and the motor support. The base, shaft, impeller and riser, and preferably all components that are in contact with molten metal, are formed of a refractory material such as graphite.

More specifically, the conduit is formed of a refractory material, preferably graphite, and includes an arcuate shaped portion in which a plurality of molten metal outlet openings are disposed. The conduit is shaped with the outlet openings arranged to enable molten metal to travel toward an interior of the conduit in upward and downward directions. Preferably, the conduit is in the shape of a ring with the conduit openings configured and arranged to discharge molten metal through the conduit outlet openings toward an interior of the ring in upward and downward directions. Thus, the exterior surfaces of a workpiece passed through the ring is simultaneously coated on all sides. The conduit may include a section that is connected to the base.

Alternatively, the conduit as described is in communication with a tubular riser. One end of the tubular riser is attached and in fluid communication with the base outlet opening. The other end of the tubular riser is attached and in fluid communication with the conduit. Molten metal discharged from the base outlet flows though the tubular riser and into the conduit. The conduit discharges the molten metal though the conduit outlet openings. The conduit openings are configured such that all surfaces of a workpiece passed therein may be coated in one pass. This is a significant advantage for continuous galvanizing operations wherein high levels of productivity and coating quality are required.

The insulating region may be a gap such that there is no contact between the conduit and the motor support (e.g., the motor mount). The insulating region preferably comprises an insulating member of a nonmetallic material, such as ceramic or other refractory. The insulating region advantageously inhibits the conduit outlet openings from clogging with hardened molten metal during operation.

Another embodiment is directed to a spray assembly for a pump for pumping molten metal. The spray assembly includes an apertured conduit adapted to be fastened near the outlet opening in the base. The conduit is constructed of dimensions and of a configuration that enable it to extend beneath the motor support so as to leave an insulating region between the conduit and the motor support. The insulating region is comprised of air or an insulating member. The insulating member is connected to the conduit and to the motor support. The conduit may be integrally formed with the insulating member that extends in the insulating region, the insulating member being preferably comprised of nonmetallic insulating material, such as ceramic or other refractory.

Another embodiment is directed to a method of coating molten metal onto workpieces, such as angle iron, and comprises flowing molten metal into the interior of the base of the transfer pump. The impeller is rotated in the interior of the base to cause molten metal to move toward the base outlet opening. The molten metal is directed from the base outlet opening to the conduit, through the outlet openings of the conduit and onto the workpiece. The conduit openings are configured so that the exterior surfaces of the workpiece are coated. The method includes inhibiting the openings of the conduit from being clogged with hardened molten metal during operation. The step of inhibiting clogging is carried out by minimizing heat transfer from the conduit to the motor support. The conduit is insulated with air or with the insulating member located in the insulating region between the conduit and the motor support. The conduit may be integrated with the insulating member and extend to the motor support. Molten metal is discharged from the conduit outlet openings in upward and downward directions so that the exterior surfaces of the workpiece are coated.

DETAILED DESCRIPTION OF THE PREFERRED EMBODIMENTS

Figure 1:
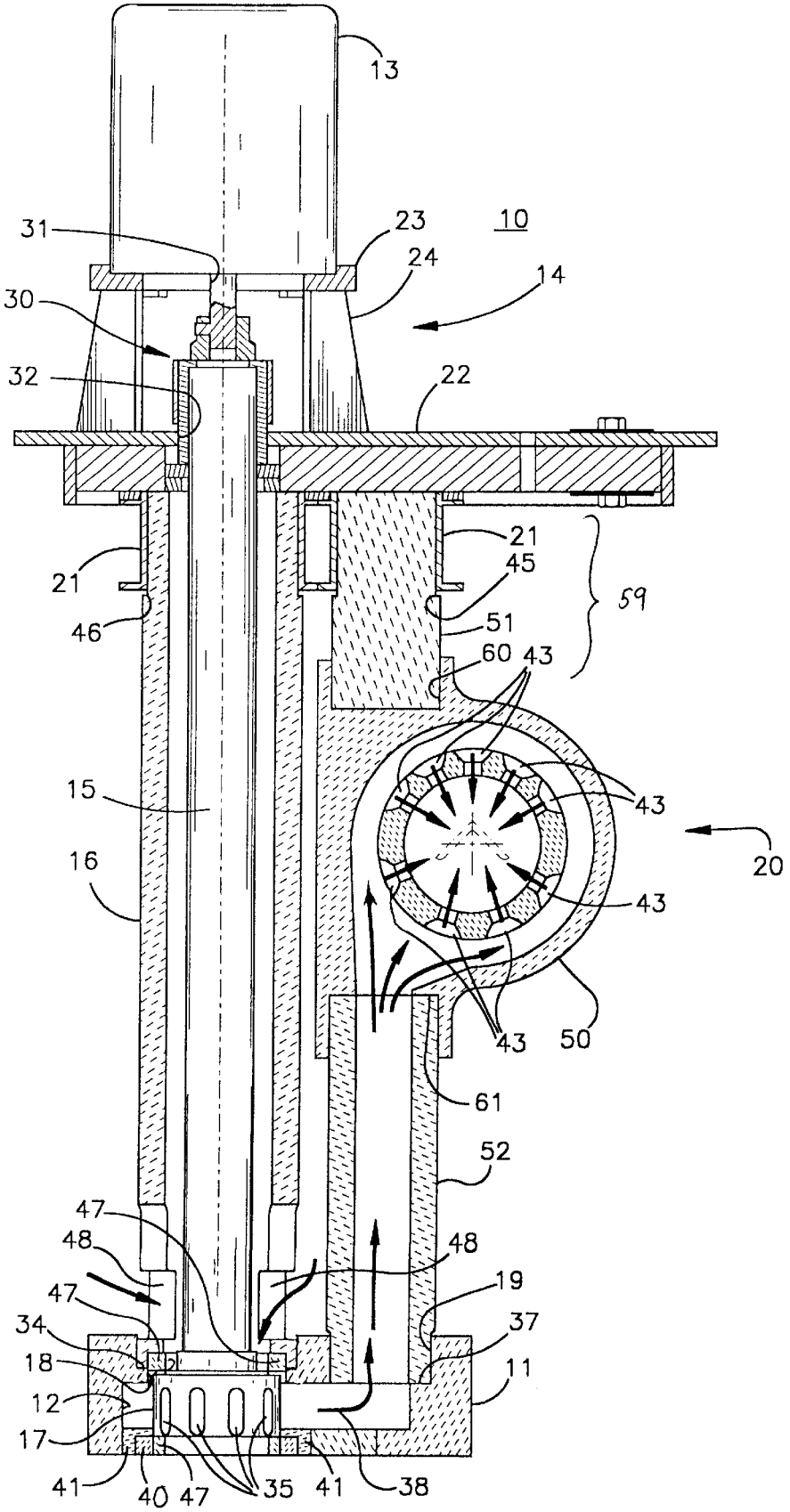
FIG. 1 is a cross sectional view of a top feed transfer pump constructed in accordance with one embodiment of the present invention.

Referring now to the drawings and to FIG. 1 in particular, the illustrated pump is generally designated by reference numeral 10 and is known as a top feed transfer pump. The pump includes a motor 13 mounted to a motor mount 14. A base 11 has an impeller chamber 12 formed therein. A shaft 15 is connected to the motor at one end. An impeller 17 is connected to the other end of the shaft. A shaft sleeve 16 surrounds the shaft. The shaft sleeve and a spray assembly 20 are disposed between the motor and the base. The shaft sleeve and the spray assembly have their lower ends fixed to the base. An optional quick release clamp 21 is carried by the motor mount. The clamp releasably clamps corresponding upper end portions of the shaft sleeve and the spray assembly in a manner that will be described hereafter.

The base 11 includes the impeller chamber 12 formed therein and at least one molten metal inlet 18 and outlet 19. The base includes recesses 34, 37 surrounding the molten metal inlet and outlet that receive lower portions of the shaft sleeve 16 and the spray assembly 20, respectively. The impeller chamber 12 houses the impeller 17 and preferably includes a spiral-shaped volute opening (not shown) surrounding the impeller. The volute opening may be an integral part of the base or may be formed by a spiral shaped volute member (not shown) surrounding the impeller. An egress channel 38 extends from the impeller chamber toward the molten metal outlet 19. During pump operation, the volute opening advantageously produces a higher molten metal outflow pressure than an impeller chamber without a volute opening. Molten metal is directed from the volute opening to the molten metal outlet via the egress channel with enough pressure to be expelled at an effective flow rate from the molten metal outlet. The impeller chamber of the base may further contain upper (not shown) and/or lower annular bearings 40 to prevent damage to the pump components from direct contact of the impeller with the base during operation of the pump. The upper bearing 47 is optional and may be omitted or, if used, may function as a non-bearing wear ring. The lower bearing ring 40, for example, may be carried by an annular lower base portion 41 which is cemented to the base around its periphery. Any suitable refractory cement may be used in this or in any other pump part that is cemented. For instance, standard refractory cements such as those sold under the trade name SUPER CHIEF® by North American Refractories, may be used. The lower portion of the impeller is normally generally coplanar with the bottom portion of the base and the bottom portion of the lower annular bearing 40. The bearings and volute member are typically cemented in place. There is an annular gap (not shown) between the annular base bearing 40 and the impeller 17 or optional impeller bearing 47 to allow for rotation of the impeller. The annular base bearings are employed to prolong the life of the impeller since during rotation the impeller will not wear the base, but rather the impeller will wear the annular base bearing(s).

The invention is not limited to any particular base construction in this or in the following embodiments. Preferred base designs including those having the volute opening are disclosed in U.S. Pat. No. 5,597,289 to Thut and in U.S. patent application Ser. No. 09/245,005 entitled "Pumps for Pumping Molten Metal," filed Feb. 4, 1999 by Thut, which are both incorporated herein by reference in their entireties.

The motor mount 14 comprises a flat mounting plate 22 including a motor support portion 23 supported by legs 24. The motor support is comprised of metal. A hanger (not shown) may be attached to the motor mount for hoisting the pump into and out of a molten metal furnace. The motor 13 is an air motor, electric motor or the like, and is directly mounted onto the motor support portion. Any construction of the motor mount may be used as known to those skilled in the art.

The shaft 15 is connected to the motor by a coupling assembly 30 and preferably in the manner shown in U.S. Pat. No. 5,622,481 to Thut, issued Apr. 22, 1997, entitled "Shaft Coupling for a Molten Metal Pump," the disclosure of which is incorporated herein by reference in its entirety. The motor mount 14 includes an opening 31 in the motor support portion 23 and an opening 32 in the mounting plate 22 which permit connecting the motor to the shaft by the coupling assembly.

The shaft sleeve 16 is cemented to the recess 34 surrounding the inlet opening 18 in the base and is prealigned to extend substantially perpendicular to the base (i.e. substantially perpendicular to the top surface and the bottom surface of the base). The shaft sleeve has openings 48 in the lower portion to provide a passageway for molten metal to flow into the base inlet opening during operation.

The impeller 17 is connected at the other end of the shaft in the well-known manner, such as by engagement of exterior shaft threads formed on the shaft with corresponding interior threads of the impeller. The impeller may include a plurality of openings 35. The invention is not limited to any particular impeller construction in this or in the following embodiments and may include vaned impellers, squirrel cage impellers or other impellers used in molten metal pumps. Preferred impeller designs are disclosed in U.S. Pat. No. 5,597,289 to Thut, U.S. Pat. Nos. 5,203,681, 4,786,230 to Thut and in U.S. Pat. No. 6,019,576 to Thut, which are incorporated herein by reference in their entireties. As to a suitable squirrel cage impeller that may be used in the present invention, reference may be made to that shown and to the squirrel cage impeller disclosed in the 6,019,576 patent with or without stirrer openings.

The spray assembly 20 includes a conduit 50, an insulating region 59 and a tubular riser 52. The tubular riser is cemented to recess 37 surrounding the base outlet opening 19 and is prealigned to extend substantially perpendicular to the base. The other end of the tubular riser is connected to the conduit according to methods known to those skilled in the art. Preferably, the conduit has a recess 61 formed in the lower portion for receiving the tubular riser.

Figure 3:
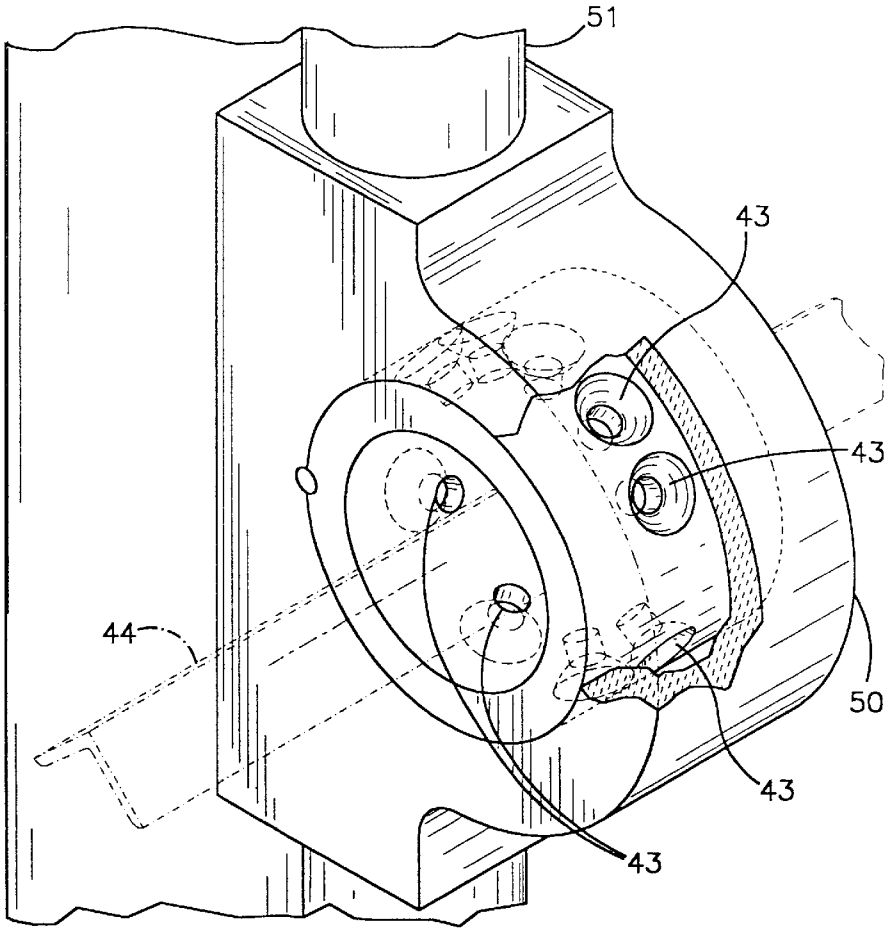
FIG. 3 is a perspective view of the conduit shown in FIG. 2.
Figure 2:
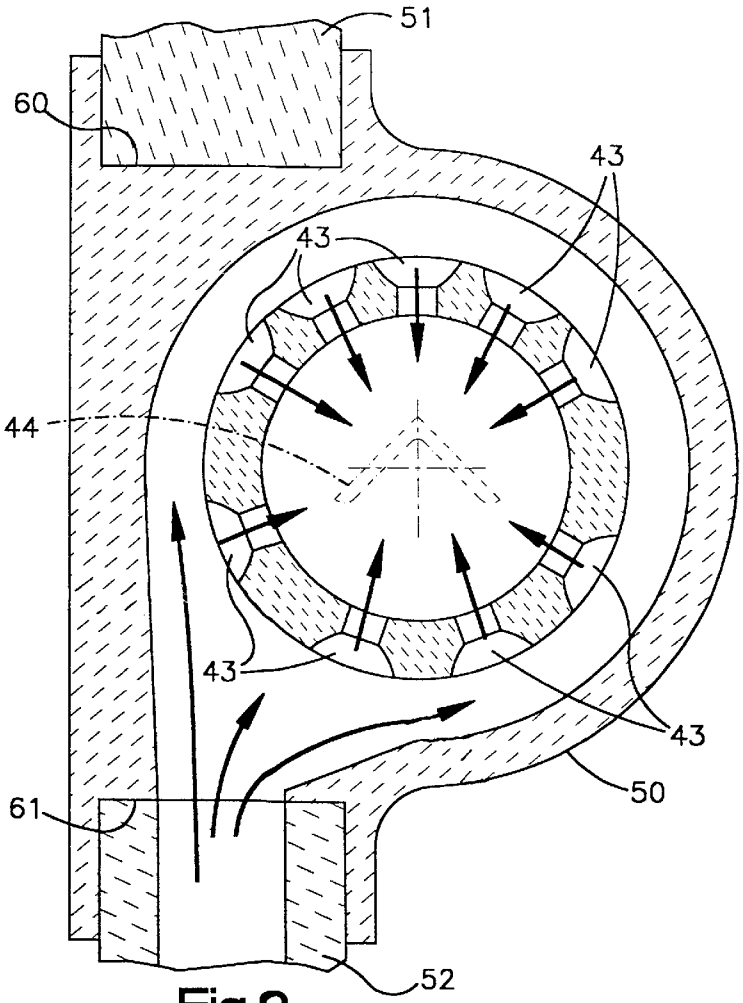
FIG. 2 is a cross sectional view of the conduit constructed according to one embodiment of the invention.

The conduit of the present invention is illustrated in FIGS. 2 and 3 and is preferably cemented to the tubular riser. Alternatively, the conduit may include an integrally formed riser section fastened directly to the molten metal outlet opening in the base. In either embodiment, the conduit is in fluid communication with the molten metal outlet. The conduit includes an arcuate shaped portion in which a plurality of molten metal outlet openings 43 are disposed. The conduit preferably has a shape so that the conduit outlet openings are configured and arranged to discharge molten metal toward an interior of the shaped conduit in upward and downward directions such that all exterior surfaces of a workpiece passed therein are coated with molten metal. Preferably, the conduit is in the shape of a ring. The size, position and number of conduit outlet openings 43 are dependent on the type of workpiece to be coated and variations thereof would be apparent to one skilled in the art in view of this disclosure. For example, the perimeter of an angle iron 44 passed through the interior of the shaped conduit is coated on all sides more efficiently and uniformly when there are more conduit openings flowing downwardly than those conduit openings flowing upwardly as illustrated in FIG. 2. The conduit openings are preferably generally funnel shaped. It is believed that the configuration and arrangement of the conduit openings uniformly distribute the molten metal under pressure from the molten metal pump to each conduit opening such that an object passed therein is uniformly coated on all sides. Preferably, the conduit is formed of a nonmetallic heat-resistant material, such as graphite. The conduit has a recess 60 on an upper peripheral surface for receiving the lower portion of an insulating member 51.

Figure 1A:
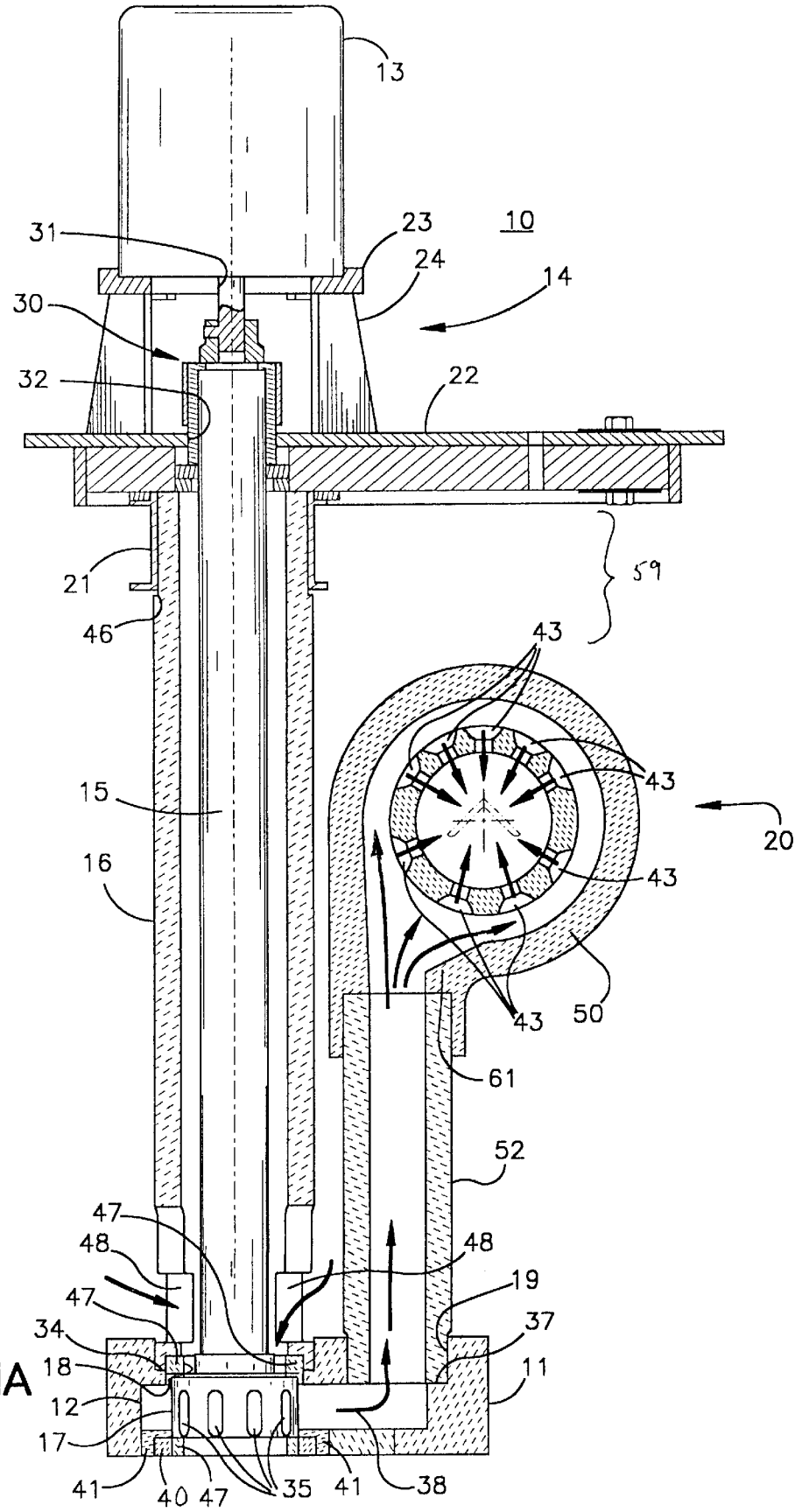
FIG. 1A is a cross sectional view of a top feed transfer pump constructed in accordance with another embodiment of the invention.

The insulating region 59 is a gap or space such that there is no direct contact between the conduit and the motor mount. The insulating region minimizes the transfer of heat from the conduit and inhibits the conduit openings from being clogged with hardened molten metal. Air (i.e. a space as shown in FIG. 1A) extends the length of the insulating region 59 or the insulating member 51 (as shown in FIG. 1) is preferably disposed in the insulating region 59 between the conduit 50 and the motor mount 14. During pump operation, the metal motor mount is generally hundreds of degrees cooler than the molten metal bath. Contact between the conduit and the motor mount will lower the temperature of any molten metal in the conduit. The conduit, as well as the pump components that come in contact with the molten metal, are made of nonmetallic refractory materials such as graphite or ceramic. Graphite is a conductor of heat. If the conduit and motor mount are in direct contact the temperature of the molten metal in the conduit falls below the melting point of the molten metal, and the conduit openings begin to clog with hardened molten metal. The insulating member or the air gap in the insulating region 59 prevents the conduit from losing enough heat to cause molten metal to harden in the conduit.

The insulating member, if used, is preferably cemented to the recess 60 in the upper peripheral surface of the conduit. The insulating member is a nonmetallic insulating material capable of withstanding the temperatures used during molten metal processing. Preferred insulators are ceramics which include oxides known to those skilled in the art to be insulators and include, but are not limited to, oxides of silicon and aluminum. Other materials suitable for use as insulating members will be apparent to those skilled in the art in view of this disclosure. The insulating member includes a groove 45 formed on the peripheral surface thereof corresponding to and mating with the quick release clamp 21.

The quick release clamp 21 is carried by the motor mount and is of the type described in U.S. Pat. No. 5,716,195 to Thut, issued Feb. 10, 1998, which is incorporated herein by reference in its entirety. The clamp is used in the instant invention when the embodiment includes an insulating member disposed in the insulating region 59. The clamp releasably clamps corresponding upper end portions of the shaft sleeve and the insulating member of the spray assembly and upper end portions of support posts alone or with the insulating member (even without the shaft sleeve). The clamp is carried on an underside of the motor mount and consists of two clamp sections each configured to embrace adjacent ends of, e.g., the shaft sleeve and the insulating member. Each of the clamp sections includes a flange (not shown) having a horizontally extending portion mountable to the motor mount and a vertically extending portion mountable to the other clamp section. Bolts fasten the clamp sections to each other and to the motor mount. Each of the clamp sections has a symmetrical configuration in the form of half of a figure-eight configured to correspond to curved peripheral surfaces of, e.g., the shaft sleeve and the insulating member. Each of the clamp sections includes a tongue (not shown) on an inner surface thereof, and the shaft sleeve and the insulating member include grooves 45 and 46 formed on the peripheral surface thereof corresponding to and mating with each tongue. This tongue-and-groove connection prevents movement of the shaft sleeve and the conduit assembly relative to the motor mount. In a preferred form of the quick release clamp, the position of the groove on the shaft sleeve is vertically staggered with respect to the position of the groove on the conduit assembly. For example, the groove on the shaft sleeve is lower than the groove on the insulating member. Accordingly, the tongue on the shaft sleeve is lower than the tongue on the insulating member. This staggered relationship between the tongues and their respective grooves further reduces the chance of slippage of the clamp on the shaft sleeve and the conduit assembly.

Although the invention has been shown used in a top feed pump, it is also suitably used in a bottom feed pump in which the impeller is inverted from the orientation used for the top feed pump and molten metal enters through a lower opening in the base and axially toward the impeller, after which it is directed radially to the outlet opening. A particularly preferred embodiment of the invention uses the pump shown in FIG. 1 with a bottom inlet (bottom feed) and an inverted squirrel cage impeller, wherein a central opening of the impeller faces downwardly. Although the shaft sleeve openings are unnecessary in this embodiment, the shaft sleeve may include a plurality of smaller openings for relieving pressure therein.

The vessel that contains the molten metal such as a a zinc kettle or a furnace, may include top and side walls sealed to provide a chamber into which inert gas such as nitrogen is introduced. This may be in the form of a removable housing for the vessel. This prevents oxidation of the molten metal coated on the workpiece and in the vessel. The design of such as inert gas chamber or housing would be apparent to one skilled in the art in view of this disclosure. The chamber or housing may include mechanical doors or baffles to permit entry and discharge of the workpieces therefrom. Inert gas may be directed through a seal around the shaft and down along the length of the shaft with or without the inert gas vessel, as disclosed in U.S. Pat. No. 5,676,520, entitled, "Method and Apparatus for Inhibiting Oxidation in Pumps for Pumping Molten Metal," which is incorporated herein by reference in its entirety. Examples of workpiece materials include structural steel in shapes that are extruded or otherwise formed, such as A-53 steel tubing ASME Standard and CRS 1018-20 cold rolled steel ASME Standard.

In operation, the transfer pump is immersed in molten metals such as aluminum, magnesium, zinc, lead, copper, iron and alloys thereof. Preferably, the molten metal comprises zinc of the type used for continuous galvanizing operations. The pump components that contact the molten metal are composed of a refractory material such as graphite. The motor is activated to rotate the shaft via the coupling assembly. Rotation of the shaft rotates the impeller and centrifugal forces cause molten metal to flow into the interior of the base such as through the multiple inlet openings of the shaft sleeve, through the base inlet opening, and then into the impeller chamber. The molten metal is then directed from the impeller passageways to the base outlet opening. From here, molten metal is directed to the tubular riser (or extension tube of the conduit). The molten metal flows up the tubular riser, through the conduit outlet openings, toward the interior of the conduit in upward and downward directions, and onto the workpiece to be coated. The conduit openings are configured such that the molten metal coats the exterior surfaces of the workpiece.

The foregoing description of the preferred embodiments of the invention has been presented for purposes of illustration and description. It is not intended to be exhaustive or to limit the invention to the precise forms disclosed. Obvious modifications or variations are possible in light of the above teachings. The embodiments were chosen and described to provide the best illustration of the principles of the invention and its practical applications to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. In a pump for pumping molten metal including a motor fastened to a motor support, a base having an impeller chamber, at least one molten metal inlet opening to the base, a molten metal outlet opening from the base, a shaft connected to the motor at one end, and an impeller connected to the other end of the shaft and rotatable in the impeller chamber, the base, the shaft and the impeller being formed of refractory material, the improvement comprising: a conduit in communication with molten metal discharged from the base outlet opening, said conduit being formed of refractory material and comprising an arcuate shaped portion having an inner wall and an outer wall, a plurality of molten metal outlet openings being disposed in the inner wall such that molten metal discharged through the openings projects toward an interior region formed by the arcuate portion to coat the perimeter surfaces of an object passed through the interior region; and an insulating region located between said conduit and said motor support effective to enable said conduit to be free from contact with heat conducting material which would lead to heat transfer and clogging of the openings.

2. The improvement of claim 1 comprising a member disposed in said insulating region, said member being comprised of nonmetallic insulating material.

3. The improvement of claim 2 wherein the nonmetallic insulating material is ceramic.

4. The improvement of claim 1 wherein said insulating region is a gap such that there is no contact between said conduit and the motor support.

5. The improvement of claim 1 wherein said motor support is comprised of metal.

6. The improvement of claim 1 wherein said conduit is comprised of graphite.

7. The improvement of claim 1 comprising a tubular riser that is connected to said conduit and to said base near said outlet opening.

8. The improvement of claim 1 wherein said conduit has a shape and said outlet openings are configured and arranged to discharge molten metal through said outlet openings toward the interior region of said conduit in a substantially vertical plane such that the perimeter surfaces of a substrate passed therein are coated.

9. The improvement of claim 1 wherein said conduit is in the shape of a ring.

10. The improvement of claim 9 wherein said outlet openings are configured and arranged to discharge molten metal through said outlet openings toward an interior of said ring in upward and downward directions such that an entire perimeter of a substrate passed therein is coated.

11. The improvement of claim 1 wherein said conduit is integrally formed with a section that extends in said insulating region and is comprised of nonmetallic insulating material.

12. A spray assembly for a pump for pumping molten metal, said assembly comprising a conduit that is adapted to be fastened to a base of a pump for pumping molten metal near an outlet opening thereof, said base having an interior in which an impeller is rotatable, said conduit being formed of refractory material and comprising an arcuate shaped portion having an inner wall and an outer wall, a plurality of molten metal outlet openings being disposed in the inner wall such that molten metal discharged through the openings projects toward an interior region formed by the arcuate portion to coat the perimeter surfaces of an object passed through the interior region, and said conduit being constructed of dimensions and of a configuration that enable said conduit to extend beneath a support for a motor of the pump so as to leave an insulating region between said conduit and the motor support effective to enable said conduit to be free from contact with heat conducting material which would lead to heat transfer and clogging of the openings.

13. The spray assembly of claim 12 further comprising a member in contact with each of said conduit and said motor support, said member being comprised of nonmetallic insulating material.

14. The spray assembly of claim 12 wherein said conduit has a shape and said outlet openings are configured and arranged to discharge molten metal toward an interior of said shaped conduit in upward and downward directions.

15. The spray assembly of claim 12 wherein said conduit is in the shape of a ring.

16. The spray assembly of claim 15 wherein said outlet openings are configured and arranged to discharge molten metal toward an interior of said ring in upward and downward directions.

17. The spray assembly of claim 12 wherein said conduit is integrally formed with a section that extends in said insulating region and is comprised of nonmetallic insulating material.

18. The spray assembly of claim 12 wherein said insulating region is an insulating member free from graphite.

19. The spray assembly of claim 12 further comprising a member in contact with said conduit, said member being comprised of nonmetallic insulating material.

20. A spray assembly for a pump for pumping molten metal, said assembly comprising a conduit that is adapted to be fastened to a base of a pump for pumping molten metal near an outlet opening thereof, said base having an interior in which an impeller is rotatable, said conduit being formed of refractory material and comprising an arcuate shaped portion in which molten metal outlet openings are disposed, and said conduit being constructed of dimensions and of a configuration that enable said conduit to extend beneath a support for a motor of the pump so as to leave an insulating region between said conduit and the motor support effective to enable said conduit to be free from contact with heat conducting material which would lead to heat transfer and clogging of the openings.

21. In a pump for pumping molten metal including a motor fastened to a motor support, a base having an impeller chamber, at least one molten metal inlet opening to the base, a molten metal outlet opening from the base, a shaft connected to the motor at one end, and an impeller connected to the other end of the shaft and rotatable in the impeller chamber, the base, the shaft and the impeller being formed of refractory material, the improvement comprising: a conduit in communication with molten metal discharged from the base outlet opening, said conduit being formed of refractory material and comprising an arcuate shaped portion in which molten metal outlet openings are disposed; and an insulating region located between said conduit and said motor support effective to enable said conduit to be free from contact with heat conducting material which would lead to heat transfer and clogging of the openings.

* * * * *